US007134266B2

(12) United States Patent
Bourbon et al.

(10) Patent No.: US 7,134,266 B2
(45) Date of Patent: Nov. 14, 2006

(54) JACKETED YARN, TEXTILE AND METHOD OF PRODUCING SUCH A YARN

(75) Inventors: Eric Bourbon, Rochetoirin (FR); Andre Ravachol, Paris (FR); Romain Ferrari, Gordes (FR)

(73) Assignee: Tissage et Enduction Serge Ferrari SA, Saint Jean de Soudain (FR)

( * ) Notice: Subject to any disclaimer, the term of this patent is extended or adjusted under 35 U.S.C. 154(b) by 0 days.

(21) Appl. No.: 10/875,093

(22) Filed: Jun. 23, 2004

(65) Prior Publication Data

US 2004/0226277 A1 Nov. 18, 2004

Related U.S. Application Data

(63) Continuation of application No. PCT/FR03/00283, filed on Jan. 30, 2003.

(30) Foreign Application Priority Data

Feb. 8, 2002 (FR) ..... 02 01577

(51) Int. Cl.
*D02G 3/02* (2006.01)

(52) U.S. Cl. ..... 57/232

(58) Field of Classification Search ..... 57/3–7, 57/210, 224, 232, 234; 428/372–374, 400
See application file for complete search history.

(56) References Cited

U.S. PATENT DOCUMENTS 3,759,027 A * 9/1973 Barnett ..... 57/256
3,924,396 A 12/1975 Bobkowicz et al. ..... 57/35
4,321,789 A * 3/1982 Dammann et al. ..... 57/224
5,326,628 A * 7/1994 Takahata et al. ..... 428/222
5,414,984 A * 5/1995 Groshens et al. ..... 57/234
5,576,081 A * 11/1996 Sandt ..... 428/36.9
6,497,950 B1 * 12/2002 Haile et al. ..... 428/364

FOREIGN PATENT DOCUMENTS

| | | |
|---|---|---|
| DE | 3301270 | 7/1984 |
| EP | 0123740 | 11/1984 |
| FR | 2617205 | 12/1988 |
| FR | 2781492 | 1/2000 |
| GB | 1290781 | 9/1972 |
| WO | WO99/42644 | 8/1999 |

* cited by examiner

*Primary Examiner*—Shaun R. Hurley
(74) *Attorney, Agent, or Firm*—Heslin Rothenberg Farley & Mesiti P.C.

(57) ABSTRACT

A sheathed yarn having a natural appearance comprises a core yarn and a sheath which is made from a thermoplastic material. The thermoplastic material of the sheath comprises less than 20 wt.-% of staple fibers, especially of natural origin. The sheathed yarn exhibits excellent mechanical properties and usage properties such as fire resistance, weatherability, resistance to sunshine, and an external appearance generating physically pleasant visual, tactile and olfactory sensations.

14 Claims, 1 Drawing Sheet

JACKETED YARN, TEXTILE AND METHOD OF PRODUCING SUCH A YARN

CROSS REFERENCE TO RELATED APPLICATIONS

This application is a continuation of International Application PCT/FR03/00283 filed on Jan. 30, 2003, and published in French as International Publication WO 03/066944 on Aug. 14, 2003, and claims priority of French patent application number 02.01577 filed on Feb. 8, 2002, the complete contents of these applications being incorporated by reference herein.

The present invention relates to a jacketed yarn of natural appearance. The present invention also relates to a textile produced from a jacketed yarn of natural appearance. The present invention also relates to a method of manufacturing a jacketed yarn of natural appearance.

Despite a growing commercial demand, it is still not known how to manufacture yarns based on thermoplastics that have both excellent mechanical properties and a natural appearance discernible both to sight and to feel. Furthermore, the environmental requirements are rarely met as regards the use of natural materials and the ability of being recycled in order to obtain products based on yarns intended for any use, for example textiles. This is particularly the case for textiles used in outdoor applications, that are subjected to foul weather and to sunshine, and for textiles that have to be fire-resistant.

PRIOR ART

Document FR-2 781 492 discloses a thermoplastic comprising fibers of plant origin, that are intended to improve the appearance as perceived by the consumer.

However, the external appearance of the products obtained proves to be relatively disappointing and very barely compatible with what is presently sought by the consumer.

Also disclosed, from document FR-2 617 205, is a jacketed yarn and a method of manufacturing a yarn by jacketing a core with a fire-resistant composition, in order to obtain a yarn and subsequently a fabric with fire resistant properties.

However, the yarn obtained still has a smooth feel, not very favorable to a range of products classed as being "environmentally friendly" and able to fall only with difficulty within environmentally friendly considerations.

SUMMARY OF THE INVENTION

A first problem that arises is how to develop a novel type ofjacketed yarn exhibiting excellent mechanical properties and excellent usage properties such as fire resistance, weatherability, resistance to sunshine, etc. A second problem that arises is how to obtain a yarn having an external appearance generating particularly pleasant visual, tactile and olfactory sensations. A third problem that arises is how to produce a yarn incorporating materials of natural origin. A fourth problem that arises is how to develop an effective method of manufacturing a yarn based on thermoplastics.

According to a first aspect of the invention, a jacketed yarn of natural appearance, having a core yarn and a jacket made of a thermoplastic, is characterized in that the thermoplastic of the jacket contains less than 20% by weight of staple fibers.

In other words, with an amount of fiber of less than or equal to 0.20% present in the jacket, the yarn will have a particularly advantageous external surface appearance. In a first embodiment, and so as to increase the strength, the core yarn may be a multifilament yarn. The core yarn may be a polyester, polyvinyl alcohol, or polyamide yarn. The thermoplastic of the jacket may preferably be chosen, by itself or as a blend, from the group of polymers and copolymers comprising polyolefins, polyesters, polyamides, polyvinyl chlorides, polyvinyl alcohols, silicones and fluoropolymers.

Advantageously, the amount of fiber in the thermoplastic of the jacket may be between 1% and 15% by weight. Preferably, this amount may be between 4% and 12% by weight. Very preferably, this amount may be between 6% and 9% by weight. Advantageously, the staple fibers may be chosen, by themselves or as a blend, from the group comprising natural fibers and synthetic fibers. The natural fibers may be hemp fibers. The staples fibers may advantageously have a mean length of between 10 μm and 500 μm. Preferably, this length may be approximately equal to 100 μm. The staple fibers may have a mean diameter of between 3 μm and 100 μm. Preferably, this diameter may be approximately equal to 20 μm.

According to a second aspect of the present invention, the textiles are characterized in that they are produced from the jacketed yarn as described above.

According to a third aspect of the invention, a method of producing a jacketed yarn of natural appearance as described above is characterized in that it includes the step consisting in jacketing a core yarn, by extrusion through a die, with a thermoplastic containing less than 20% by weight of staple fibers.

The thermoplastic containing less than 20% by weight of fiber may advantageously be obtained by blending, one or more times, a non-fiber-filled thermoplastic with a masterbatch containing from 5% to 80% by weight of fiber. The masterbatch may preferably contain between 20% and 70% by weight of fiber. And very preferably, the masterbatch may contain between 40% and 60% by weight of fiber.

DESCRIPTION OF THE DRAWING

The invention will be better understood and its various advantages and features will become more clearly apparent from the following description of nonlimiting illustrative examples, with reference to the appended schematic drawing in which.

DETAILED DESCRIPTION

Figure 1:
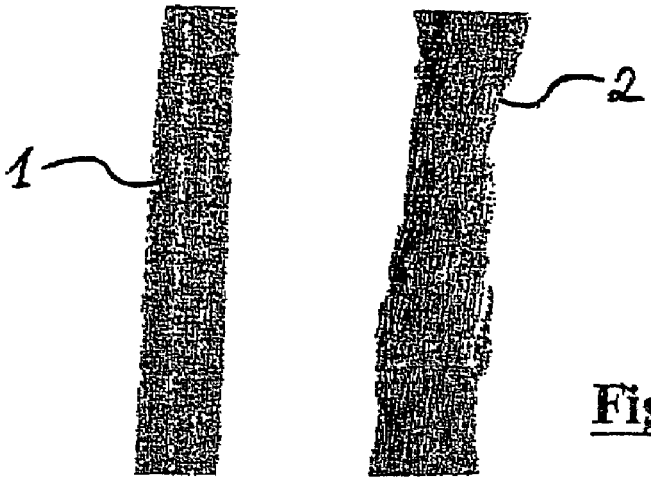
FIG. 1 shows an enlarged longitudinal view of a jacketed yarn according to the prior art and of a jacketed yarn according to the invention.

The core is covered, by extrusion or coating, with a layer of peripheral polymer material. The photographs, enlarged about 20 times in FIG. 1, show a comparison between a jacketed yarn (1) according to the prior art (on the left), represented by document FR-2 617 205, and a jacketed yarn (2) according to the present invention (on the right). Owing to the presence of staple fibers, the external surface of the yarn (2) obtained by the method according to the invention has an irregular appearance and resembles string. The mean diameter may thus be less than 1 mm and vary between 0.6 mm and 0.9 mm. In contrast, the external surface of the conventional jacketed yarn (1) is smooth.

Advantageously, and in practice, the core yarn is a high-tenacity multifilament yarn, that is to say one having a tenacity of around at least 50 cN/tex. The many filaments of the core may or may not be twisted, may or may not be interlaced, may or may not be assembled and may or may not be texturized, depending on the final jacketed yarn desired.

Figure 2:
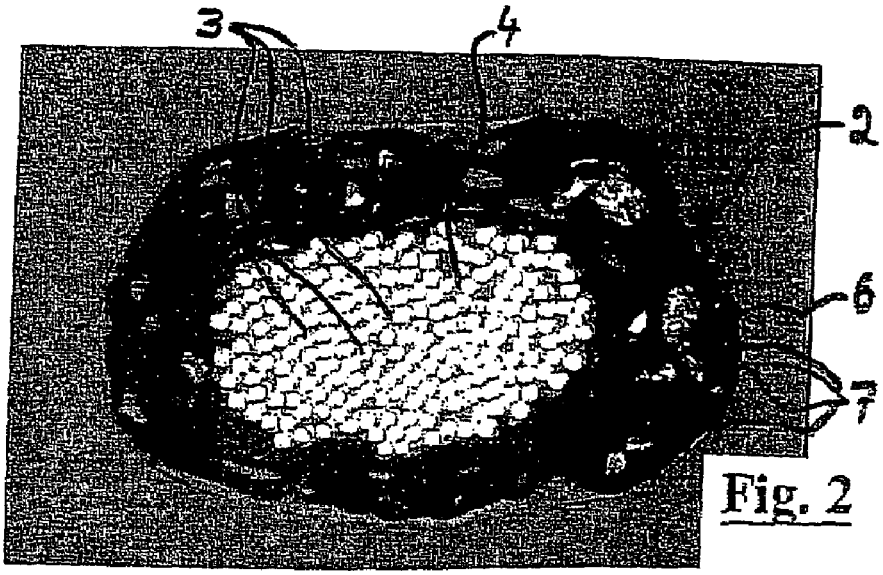
FIG. 2 shows a cross-sectional view taken in an optical microscope of the jacketed yarn according to the invention.

FIG. 2 shows a cross section through the jacketed yarn (2) taken in an optical microscope with a magnification of about 150 times. In this embodiment of the jacketed yarn (2), the many polyester filaments (3) of the core (4) appear at the center. The jacket (6) based on a PVC compound surrounds the core (4). As this photograph shows, the jacket (6) incorporates hemp fibers (7) embedded in the PVC. The perimeter of the jacket (6) is very irregular, giving the overall yarn a natural feel.

In another embodiment, the core and the jacket are produced directly by coextrusion.

Advantageously, and in practice, the jacket (6) is extruded around the core yarn (4). The thermoplastic polymer compositions of the jacket furthermore advantageously include supplementary additives, namely at least one UV stabilizer and/or at least one biocide and/or at least one mineral filler and/or at least one pigment and/or at least one fire retardant. The fire retardant may be mineral fire-retarding fillers such as, for example, antimony oxides, alumina trihydrate, zinc oxide or magnesium oxide.

The weight ratio of the core yarn (4) to the jacket (6) depends both on the final applications envisioned and on the extrusion or coating equipment available.

Such yarns may be employed in many applications, and especially in the manufacture of furniture, typically camping seats, automobile fabrics, floor and wall coverings, solar protection devices, articles of luggage, protective fabrics, and yet others.

Figure 3:
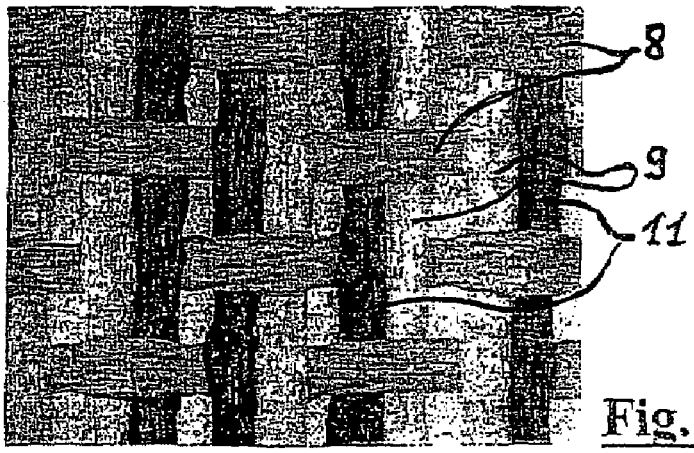
FIG. 3 shows an enlarged top view of a textile made from jacketed yarn.

FIG. 3 shows an example of a textile enlarged about 10 times, entirely made from yarns (2), with a 100% polyester core jacketed with a PVC compound containing hemp fibers according to the invention, and heat-set. The textile comprises a warp yarn (8) in the horizontal direction and two weft yarns (9 and 11) in the vertical direction. It will be noted that the yarns are differently colored.

ILLUSTRATIVE EXAMPLES

A jacketed yarn (2) according to the present invention was produced in the following manner. An 1100 dtex polyester yarn, sold by Rhodia under the name "Type 156", was jacketed by extrusion through a die. The run speed of the yarn was 300 m/min.

The extruded jacketing composition comprised:

7% of hemp fibers; and

93% of plasticized, formulated and pigmented PVC.

Thus, a 4700 dtex jacketed yarn having a mean diameter of 0.67 mm was obtained; in other words, the polyester core yarn represented 23.4% by weight and the fiber-containing jacket represented 76.6% by weight.

In addition, the jacketed yarn obtained had the following characteristics and mechanical properties:

tensile strength: 9.6 daN; and elongation at break: 14.5%.

This yarn was therefore perfectly suitable for the manufacture of textiles that can be heat-set.

The present invention is not limited to the embodiments described and illustrated. Many modifications may be made, without thereby departing from the context defined by the scope of the set of claims.

For example, it would be possible to devise a core made of various materials, such as glass fibers, optical fibers or one or more wires.

The invention claimed is:

1. A textile composed entirely of a jacketed yarn of natural appearance, having a core yarn and a jacket made of a thermoplastic continuously covering a full outer surface of the core yarn, wherein the jacket contains a blend of the thermoplastic with between 1% and 15% by weight of staple fibers, and wherein the thermoplastic of the jacket is chosen, by itself or as a blend, from the group of polymers and copolymers comprising polyolefins, polyesters, polyamides, polyvinyl chlorides, polyvinyl alcohols, silicones and fluoropolymers.

2. The textile as claimed in claim 1, wherein the textile comprises warp yarns and weft yarns all composed of the jacketed yarn.

3. The textile as claimed in claim 1, wherein the core yarn is a multifilament yarn.

4. The textile as claimed in claim 1, wherein the core yarn is a polyester, polyvinyl alcohol or polyamide yarn.

5. The textile as claimed in claim 1, wherein the staple fibers are chosen, by themselves or as a blend, from the group comprising natural fibers and synthetic fibers.

6. The textile as claimed in claim 5, wherein the natural fibers are hemp fibers.

7. The textile as claimed in claim 1, wherein the staple fibers have a mean length of between 10 μm and 500 μm and a mean diameter of between 3 μm and 100 μm.

8. The textile as claimed in claim 1, wherein the amount of fiber in the thermoplastic of the jacket is between 4% and 12% by weight.

9. The textile as claimed in claim 1, wherein the amount of fiber in the thermoplastic of the jacket is between 6% and 9% by weight.

10. The textile as claimed in claim 7, wherein the staple fibers have a mean length approximately equal to 100 μm and a mean diameter approximately equal to 20 μm.

11. The textile as claimed in claim 1, wherein the jacketed yam is produced according to a method including a step of jacketing a core yam to continuously cover a full outer surface of the core yarn, by extrusion through a die, of a blend of a thermoplastic containing less than 20% by weight of staple fibers.

12. The textile as claimed in claim 11, wherein the thermoplastic containing less than 20% by weight of fiber is obtained by blending, one or more times, a non-fiber-filled thermoplastic with a masterbatch containing from 5% to 80% by weight of fiber.

13. The textile as claimed in claim 11, wherein the thermoplastic containing less than 20% by weight of fiber is obtained by blending, one or more times, a non-fiber-filled thermoplastic with a masterbatch containing from 20% to 70% by weight of fiber.

14. The textile as claimed in claim 11, wherein the thermoplastic containing less than 20% by weight of fiber is obtained by blending, one or more times, a non-fiber-filled thermoplastic with a masterbatch containing from 40% to 60% by weight of fiber.

* * * * *